US007908802B2

(12) United States Patent
Frederiksen

(10) Patent No.: US 7,908,802 B2
(45) Date of Patent: Mar. 22, 2011

(54) SYSTEM FOR CONSTRUCTING TREAD SURFACES

(75) Inventor: Ole Frederiksen, Hornslet (DK)

(73) Assignee: Excellent Systems A/S, Mørke (DK)

( * ) Notice: Subject to any disclaimer, the term of this patent is extended or adjusted under 35 U.S.C. 154(b) by 416 days.

(21) Appl. No.: 11/666,565

(22) PCT Filed: Oct. 13, 2005

(86) PCT No.: PCT/DK2005/000656

§ 371 (c)(1),
(2), (4) Date: Apr. 27, 2007

(87) PCT Pub. No.: WO2006/045309

PCT Pub. Date: May 4, 2006

(65) Prior Publication Data

US 2009/0044473 A1 Feb. 19, 2009

(30) Foreign Application Priority Data

Oct. 29, 2004 (DK) ..... 2004 01666

(51) Int. Cl.
*E04F 15/02* (2006.01)

(52) U.S. Cl. ..... 52/177; 52/98; 52/589.1; 52/585.1

(58) Field of Classification Search ..... 52/177, 52/578, 589.1, 590.1, 591.1, 590.2, 592.1, 52/98, 99, 100, 582.1, 585.1; 472/92
See application file for complete search history.

(56) References Cited

U.S. PATENT DOCUMENTS

| | | | | | |
|---|---|---|---|---|---|
| 2,653,525 | A | * | 9/1953 | McGuire | 404/35 |
| 3,500,606 | A | * | 3/1970 | Wharmby | 52/591.1 |
| 3,802,144 | A | | 4/1974 | Spica | |
| 4,008,548 | A | * | 2/1977 | Leclerc | 52/180 |
| 4,167,599 | A | * | 9/1979 | Nissinen | 428/44 |
| 4,287,693 | A | * | 9/1981 | Collette | 52/177 |
| 4,373,306 | A | * | 2/1983 | Rech | 52/98 |
| 4,436,779 | A | * | 3/1984 | Menconi et al. | 428/169 |
| 4,468,910 | A | * | 9/1984 | Morrison | 52/591.2 |
| 4,584,221 | A | * | 4/1986 | Kung | 428/44 |
| 4,807,412 | A | * | 2/1989 | Frederiksen | 52/177 |
| 4,860,510 | A | * | 8/1989 | Kotler | 52/177 |
| 4,930,286 | A | * | 6/1990 | Kotler | 52/177 |
| 5,509,244 | A | * | 4/1996 | Bentzon | 52/387 |
| 5,511,353 | A | * | 4/1996 | Jones | 52/536 |
| 5,595,033 | A | * | 1/1997 | Frey | 52/306 |
| 5,616,389 | A | * | 4/1997 | Blatz | 428/45 |

(Continued)

FOREIGN PATENT DOCUMENTS

| | | |
|---|---|---|
| CH | 540398 | 8/1973 |

(Continued)

*Primary Examiner* — Brian E Glessner
(74) *Attorney, Agent, or Firm* — James Creighton Wray; Meera P. Narasimhan

(57) ABSTRACT

The present invention relates to a system for constructing tread surfaces comprising polygonal elements (1) where each element has a top surface and a number of substantially straight side edges arranged perpendicular to the top surface along the periphery of said top surface and that all side edges (2) are provided with a number of receiving openings (3) each opening adapted to receive and maintain a connector member, and that said elements (1), furthermore, along one or more of said side edges (4) are provided with one or more integrated and protruding connector members (5) which each are adapted to fit into said receiving openings (3).

4 Claims, 2 Drawing Sheets

U.S. PATENT DOCUMENTS

| | | | | |
|---|---|---|---|---|
| 5,628,160 | A * | 5/1997 | Kung | 52/591.1 |
| 5,634,309 | A * | 6/1997 | Polen | 52/392 |
| 5,713,175 | A * | 2/1998 | Mitchell | 52/582.1 |
| 5,777,266 | A * | 7/1998 | Herman et al. | 174/68.1 |
| 5,787,654 | A * | 8/1998 | Drost | 52/177 |
| 5,904,021 | A * | 5/1999 | Fisher | 52/578 |
| 5,907,934 | A * | 6/1999 | Austin | 52/177 |
| 5,950,378 | A * | 9/1999 | Council et al. | 52/177 |
| 5,992,106 | A * | 11/1999 | Carling et al. | 52/177 |
| 6,061,979 | A * | 5/2000 | Johannes | 52/177 |
| 6,089,784 | A * | 7/2000 | Ardern | 404/41 |
| 6,098,354 | A * | 8/2000 | Skandis | 52/177 |
| 6,161,353 | A * | 12/2000 | Negola et al. | 52/453 |
| 6,370,831 | B1 * | 4/2002 | Marshall et al. | 52/263 |
| 6,451,400 | B1 * | 9/2002 | Brock et al. | 428/44 |
| 6,467,224 | B1 * | 10/2002 | Bertolini | 52/177 |
| 6,526,710 | B1 * | 3/2003 | Killen | 52/220.1 |
| 6,579,038 | B1 * | 6/2003 | McAllister et al. | 405/16 |
| 6,588,167 | B2 * | 7/2003 | Chang | 52/590.1 |
| 6,622,440 | B2 * | 9/2003 | Mercade | 52/177 |
| 6,718,588 | B1 * | 4/2004 | Frederiksen | 14/69.5 |
| 6,745,532 | B1 * | 6/2004 | Vazquez Ruiz del Arbol | 52/414 |
| 6,751,912 | B2 * | 6/2004 | Stegner et al. | 52/177 |
| 6,802,159 | B1 * | 10/2004 | Kotler | 52/177 |
| 6,954,975 | B2 * | 10/2005 | Dolinski | 29/428 |
| 6,993,801 | B2 * | 2/2006 | Marko et al. | 14/69.5 |
| 7,114,298 | B2 * | 10/2006 | Kotler | 52/177 |
| 7,299,592 | B2 * | 11/2007 | Moller, Jr. | 52/180 |
| 7,331,147 | B2 * | 2/2008 | Kalisiak et al. | 52/385 |
| 2002/0122912 | A1 * | 9/2002 | Brock et al. | 428/44 |
| 2002/0152702 | A1 * | 10/2002 | Tseng | 52/403.1 |
| 2002/0189176 | A1 * | 12/2002 | Stegner et al. | 52/177 |
| 2003/0061772 | A1 * | 4/2003 | Bertolini | 52/98 |
| 2003/0089051 | A1 * | 5/2003 | Bertolini | 52/177 |
| 2003/0196399 | A1 * | 10/2003 | Wu | 52/422 |
| 2003/0208979 | A1 * | 11/2003 | Sorensen et al. | 52/591.1 |
| 2004/0226242 | A1 * | 11/2004 | Moller, Jr. | 52/384 |
| 2004/0258869 | A1 * | 12/2004 | Walker | 428/44 |
| 2005/0066606 | A1 * | 3/2005 | Dolinski | 52/582.2 |
| 2005/0108968 | A1 * | 5/2005 | Forster | 52/578 |
| 2005/0252109 | A1 * | 11/2005 | Fuccella et al. | 52/177 |
| 2006/0053725 | A1 * | 3/2006 | Su | 52/590.1 |
| 2006/0070314 | A1 * | 4/2006 | Jenkins et al. | 52/177 |
| 2006/0260223 | A1 * | 11/2006 | Wang | 52/177 |
| 2006/0265975 | A1 * | 11/2006 | Geffe | 52/177 |
| 2006/0283125 | A1 * | 12/2006 | Moller, Jr. | 52/578 |
| 2007/0006544 | A1 * | 1/2007 | Washburn | 52/588.1 |
| 2007/0044412 | A1 * | 3/2007 | Forster et al. | 52/592.1 |
| 2007/0094979 | A1 * | 5/2007 | Richardson et al. | 52/578 |
| 2007/0094980 | A1 * | 5/2007 | McGivern et al. | 52/578 |
| 2008/0127593 | A1 * | 6/2008 | Janesky | 52/581 |
| 2008/0134593 | A1 * | 6/2008 | Moller | 52/177 |
| 2008/0216437 | A1 * | 9/2008 | Prevost et al. | 52/589.1 |
| 2009/0031658 | A1 * | 2/2009 | Moller et al. | 52/403.1 |
| 2009/0031662 | A1 * | 2/2009 | Chen et al. | 52/515 |

FOREIGN PATENT DOCUMENTS

| | | |
|---|---|---|
| EP | 0982448 A1 | 3/2000 |
| FR | 2651257 | 3/1991 |

* cited by examiner

SYSTEM FOR CONSTRUCTING TREAD SURFACES

This application claims the benefit of Danish Application No. PA 2004 01666 filed Oct. 29, 2004 and PCT/DK2005/000656 filed Oct. 13, 2005, which are hereby incorporated by reference in their entirety.

FIELD OF THE INVENTION

The present invention relates to a system for constructing tread surfaces comprising polygonal elements which along at least one side edge are provided with a number of receiving openings, each adapted to receive and maintain a separate connector member.

BACKGROUND OF THE INVENTION

In U.S. Pat. No. 5,509,244 a flooring system is described comprising tiles provided along all the side edges with receiving openings, each adapted to receive and maintain a separate connector member, whereby it is possible to connect adjacently positioned identical tiles in a secure manner.

The separate connector members are formed with two head parts connected with a beam part, hence it is possible to fit a first head part into a receiving opening of a first tile, and then fit the second head part into a receiving opening of a second tile, thereby connecting the two tiles in a secure manner.

It is a disadvantage to have separate connector members for the connection of the adjacent tiles, because either a number of separate connector members must be pre-mounted to one tile, or the separate connector members must be mounted during the layout of the tiles in order to form a tread surface. Either method is very time consuming to perform before the layout.

Furthermore, there will be a risk of loosing the separate connector members before the layout of tiles, or the separate connector members will fall out of engagement with the receiving openings due to their downwardly directed openings when the tile is positioned.

From a production point of view it is a rather costly procedure in that one machine is used for producing the tiles and another machine is necessary for producing the connector members, and either a robot or manual labour is necessary in order to place the connectors in the appropriate receiving openings in the side edges of the floor tiles.

From U.S. Pat. No. 4,373,306 another surface system is known. In this system, the separate elements are moulded with combined dovetails and corresponding receiving recesses, such that the dovetails are moulded in the recesses. The dovetails extend out from the side of the surface elements such that by maintaining the dovetails in one element and removing it in an adjacent element, and thereby freeing up the recess, it becomes possible to insert the dovetail of one element in the recess of the adjacent element and thereby connect the two adjacent elements. When, however, a dovetail becomes damaged it cannot be replaced, and the entire element needs to be replaced by another new complete element.

OBJECT OF THE INVENTION

It is an object of the present invention to provide a system for constructing tread surfaces where the disadvantages listed above are overcome, and which system provides further advantages.

This is obtained by a system as described in claim 1.

DESCRIPTION OF THE INVENTION

The system is preferably used when constructing a tread surface e.g. a staircase, a plateau, a terrace, a floor, or the like. These tread surfaces can either be permanent or be removable.

The tread surfaces may be used as a surface op top of for example an underlying stabile floor, where the tread surface may exhibit special characteristics like non-skid surfaces, protection surfaces, or drainages surfaces. In other embodiments, the tread surfaces may be used as a surface on e.g. an underlying layer as a stabilising surface, a levelling surface, or a rising surface.

The present invention therefore provides a system for constructing tread surfaces comprising polygonal elements where each element has a top surface and a number of substantially straight side edges arranged perpendicular to the top surface along the periphery of said top surface and that all side edges are provided with a number of receiving openings each opening adapted to receive and maintain a connector member, and that said elements, furthermore, along one or more of said side edges are provided with one or more integrated and protruding connector members which each are adapted to fit into said receiving openings.

This system foresees that all necessary parts are present in order to connect adjacent elements together. The receiving openings and the connector members are arranged with mutual fixed module distances, such that the integral connector members along one side edge in a standard assembly configuration, will be placed facing receiving openings in the adjacent element. If the adjacent elements are arranged offset, the relationship between the connectors and the receiving openings will again fit, if the replacement is offset a multiplum of module distances. This is one of the reasons why.

When placing the elements in special patterns or along a wall it may be necessary to remove the integrated connector members, as they may not be placed facing a receiving opening or there is not enough space, i.e. when being placed along a wall. In the first instance where the laying pattern necessitates that the connectors be removed as there is no facing receiving opening separate connector members may be used to connect two adjacent elements. Also in instances where a system or parts of the surface system is being reused, single elements are being removed or replaced, the connector members may have been damaged or torn off. Also in these circumstances loose connector members may be utilised in order to connect adjacent elements. The inventive elements are therefore provided with both a number of receiving openings each adapted to receive and maintain a separate connector member and a number of integrated and protruding connector members, which each are adapted to fit into said receiving opening.

The receiving openings are formed so it is possible to receive both the integrated and protruding connector members and the separate connector member. In a preferred embodiment of the present invention the two different connector members have corresponding protruding forms, whereby it is possible to only provide one form of the receiving openings.

The integrated and protruding connector members make it possible to connect two adjacent elements easily and quickly in a secure manner by laying a first element in the right position, and then positioning a second element's receiving openings on top of the first element's integrated and protruding connector members, hence the two elements are connected.

Within the context of this invention the term "integral" shall be construed as meaning that the feature, for example the connector members are cast or otherwise formed with the elements in one operation, for example the elements may be cast in a mould, wherein provisions are made for casting the connector members at the same time. In order to displace an integral feature, the element from which it is being displaced will be damaged. This is different to the term separate, whereby is implied that the item may be manufactured as a completely stand alone element even at a different location.

As described in the section regarding the background of the invention, separate connector members can be used to connect two receiving openings of adjacently positioned elements, whereby a secure tread surface can be provided.

In an embodiment where it may be desirable to add extra stiffness to the tread surface, two adjacent elements can be connected by using a combination of both the integrated and protruding connector members, and separate connector members engaging in the receiving openings along the side edges of the elements.

Furthermore, it is possible to replace every integrated and protruding connector member with a separate connector member, if the first is either damaged or broken off due to the stresses or strains of any loads positioned on the tread surfaces.

To ensure that adjacent elements are securely connected without any possibility to move separately, each of said receiving openings comprise an enclosed channel part, and said connector member comprises a head part having a form complementary to the form of said enclosed channel part. Hence, the lateral movement of the elements is prevented, because the head part of each connector member fits closely into the enclosed channel part of each receiving openings.

The tight fit of several head parts into the respectively enclosed channel part of each receiving opening makes it easy to layout the elements because the elements can only fit together in one way, and it is easy to view any incorrectly positioned, or non connected elements.

This only applies when the system is placed in the originally designed pattern, where the connector members and the receiving openings are supposed to be superposed in order to assemble the surface. In other instances or designs, the connector members may be broken off in order to fit or rearrange the elements of the system to the surface covering at hand.

For allowing a smooth side edge on the side edges where the elements are provided with integrated and protruding connector members, said integrated and protruding connector members are provided with a break-off area.

This makes it possible to enhance the flexibility of the elements, because the integrated and protruding connector members which may be broken off will not have to fit together with receiving openings. Hence, it is possible to rotate the elements as wanted, and then provide a tread surface with different patterns, or provide a tread surface made of elements of different sizes.

In a preferred embodiment of the present invention said element is a rectangle, and along two adjacent side edges it is provided with integrated and protruding connector members, and along the opposite side edges provided with a number of receiving openings.

This kind of element makes is easy and quick to construct a tread surface in one or more layers, because it is possible to lay down a first row of elements, and then lay down the following rows of elements by connecting the connector members with the receiving openings.

To ensure that adjacent elements are connected in a secure manner, said receiving openings are positioned in pairs along said side edge. Hence, the connector members fitted into a pair of receiving openings will provide a stable and stiff connection, which is able to withstand high amounts of twists and strains of the adjacent elements. This will, further, be enhanced if there along adjacent side edges are used connector members in more than one pair of receiving openings.

If the side edges of the element are provided with a number of integrated and protruding connector members for the connection of the adjacent elements, said integrated and protruding connector members are positioned in pairs with one receiving opening.

Hence, it is possible to use a separate connector member in the receiving opening positioned opposite a receiving opening of the adjacent element concurrent with the connection of the integrated and protruding connector members with an oppositely positioned receiving opening.

This will enhance the safety of the connection of the adjacent elements, because if the integrated and protruding connector members are damaged or broken off, the separate connector members will ensure that the two adjacent elements are still securely connected until it is possible to either exchange the element, or to exchange the integrated and protruding connector members.

In one embodiment of the present invention said receiving openings are positioned in said side edge with a downwardly directed opening. Hence, the head part of the connector member is fully enclosed in the channel part of the receiving opening. Furthermore, it will be possible to provide an element with a smooth surface.

Alternatively, the receiving openings are through going in the side edge, but still comprise a subjacent enclosed channel part. Hence, it is possible to engage the head part into the channel part from either the top, or the bottom of the side edges.

The inventive concept may therefore be summed up as follows: with the present invention a versatile surface element is provided which is more economic to manufacture as the entire element with its inherent advantages may be manufactured in one mould in one operation. By furthermore providing integral connector members in the side edges and a plurality of receiving openings in the side edges as well, it is foreseen that the elements may effortlessly and conveniently be connected together without any loose or special parts. Even in off-set patterns, the elements may be connected due to the provision of a plurality of receiving openings and connector members. Also where the off-set pattern is so off that the system may not immediately be compatible, the use of separate connector members having head sections in both ends being connected by a beam section may be placed into adjacently placed receiving openings, and thereby connect two adjacent elements. Also should a protruding connector member be damaged or torn off, the loose connector members may be utilised, such that the element itself may be reused.

DESCRIPTION OF THE DRAWING

The invention is described in more detail below with reference to the accompanying drawings in which.

DETAILED DESCRIPTION OF THE INVENTION

Figure 1:
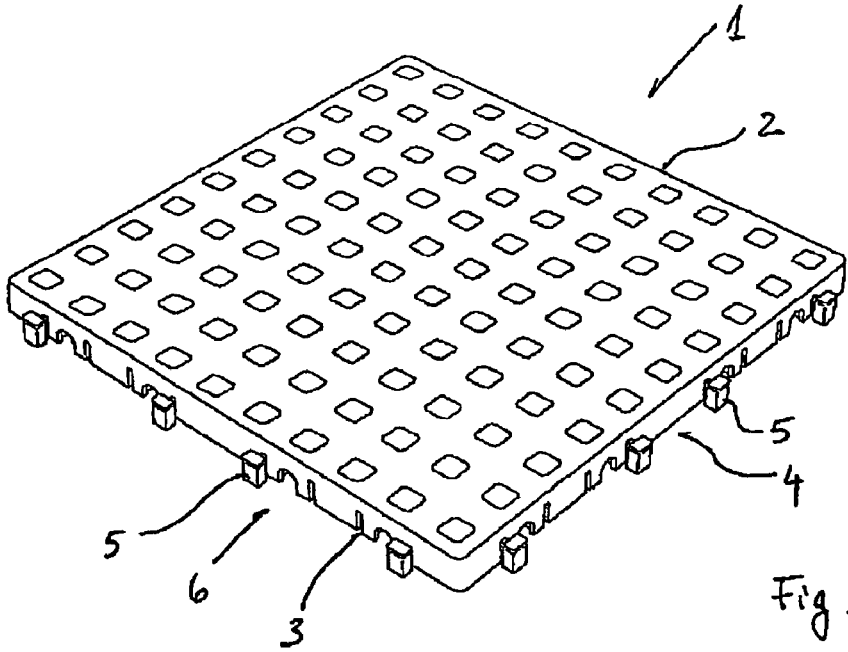
FIG. 1 shows an front view of an element according to the present invention.

FIG. 1 shows an polygonal element 1 for constructing tread surfaces, which along at least one side edge 2 is provided with a number of receiving openings 3, each adapted to receive and maintain a separate connector member (not shown) and the element 1, furthermore, along at least one side edge 4 is provided with a number of integrated and protruding connector members 5, which each are adapted to fit into said receiving opening 3 of an adjacent element (not shown). The integrated and protruding connector members 5 are positioned along side edge 4 in pairs 6 with a receiving opening 3.

Figure 2:
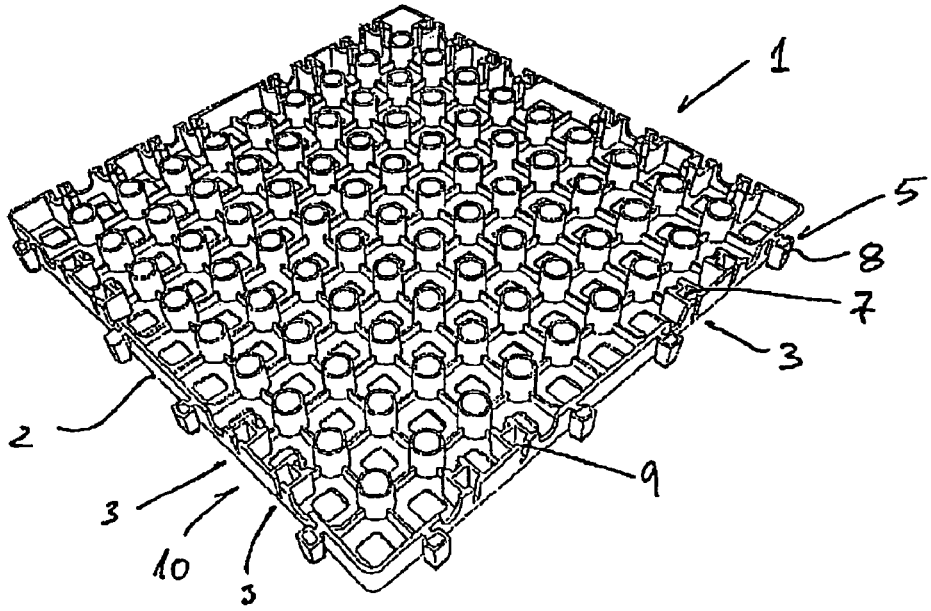
FIG. 2 shows a front view of an element according to the present invention.

FIG. 2 shows an element 1 from the backside, where it is possible to see that every receiving opening 3 comprises a subjacent enclosed channel 7, which is formed complementary to the form of the head part 8 of the integrated and protruding connector members 5. Hence, the engaging of integrated and protruding connector members 5 and the receiving opening 3 of adjacent elements 1 will be secure, stable and prevent any possible lateral movement of adjacent elements 1. Furthermore, it is possible to see that every receiving opening 3 is provided with a downwardly directed opening 9, and that the receiving openings 3 on side edge 2 are positioned in pairs 10.

Figure 3:
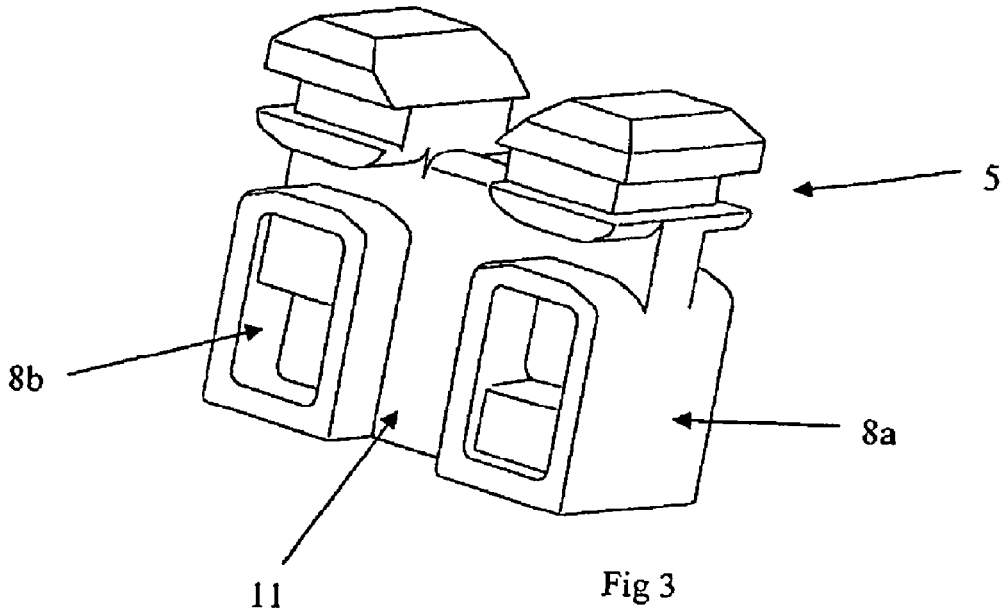
FIG. 3 illustrates a replacement connector member.
Figure 4:
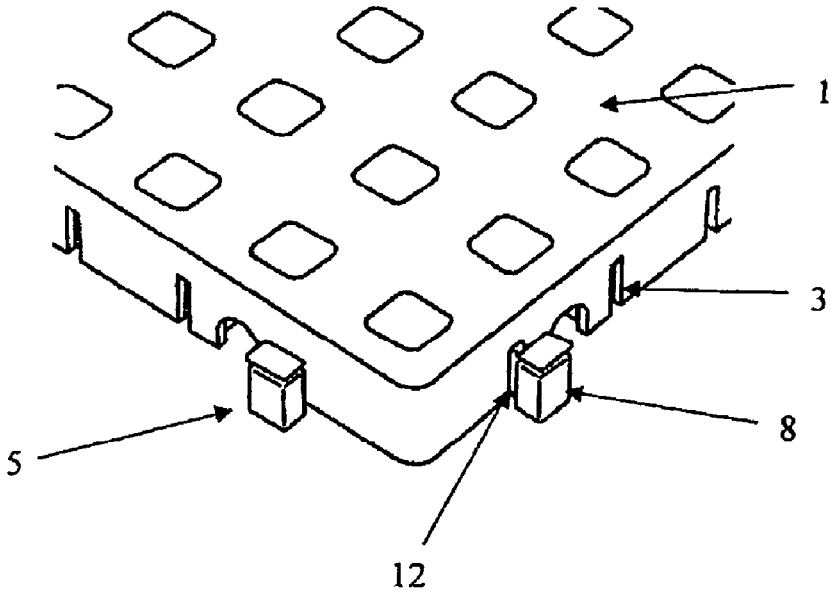
FIG. 4 illustrates a break-off area on a connector.

The separate connector members, illustrated in FIG. 3 are formed with two head parts 8*a*, 8*b* connected with a beam part 11, hence it is possible to fit a first head part 8*a* into a receiving opening 3, see FIG. 4, of a first tile, and then fit the second head part 8*b* into a receiving opening of a second tile, thereby connecting the two tiles in a secure manner.

In FIG. 4 is illustrated an embodiment where the connector member 5 is provided with a break off area 12. In order to obtain a smooth side edge on the side edges where the elements are provided with integrated and protruding connector members and where said side edge is not engaged with other tiles, said integrated and protruding connector members are provided with a break-off area.

This makes it possible to enhance the flexibility of the elements, because the integrated and protruding connector members which may be broken off will not have to fit together with receiving openings. Hence, it is possible to rotate the elements as wanted, and then provide a tread surface with different patterns, or provide a tread surface made of elements of different sizes, or achieve a smooth finishing edge.

The invention claimed is:

1. A system for constructing tread surfaces comprising polygonal elements (1) wherein each element has a top surface and a number of substantially straight side edges arranged perpendicular to the top surface along a periphery of said top surface and that all side edges (2) are provided with two or more receiving openings (3) each opening adapted to receive and maintain a connector member, and that said elements (1), furthermore, along one or more of said side edges (4) are provided with one or more integrated and protruding connector members (5) which each are adapted to fit into said receiving openings (3), wherein in each of said receiving openings (3) comprises an enclosed channel part (7) and said connector member (5) comprises a head part (8) having a form complementary to a form of said enclosed channel part (7), further comprising replacement connector members which connector members comprise a central beam section connecting two heads, which beam has a cross-section such that it will fit in the receiving openings (3) of the elements (1), and a length corresponding to approximately twice the thickness of the side edges, and that the heads have a size substantially larger than the receiving openings (3).

2. The system according to claim 1, wherein said integrated and protruding connector members (5) are provided with a break-off area.

3. The system according to claim 1 wherein the polygonal elements including recesses and connector members are injection moulded or die cast from a plastic material.

4. The system according to claim 1, wherein said receiving openings (3) are positioned in said side edge (2,4) with a downwardly directed opening.

* * * * *